United States Patent [19]

Goble

[11] Patent Number: 4,944,101

[45] Date of Patent: Jul. 31, 1990

[54] APPARATUS AND METHOD FOR RECOVERING MATERIALS FROM FLUID BODIES

[76] Inventor: Robert H. Goble, P.O. Box 690013, Orlando, Fla. 32869

[21] Appl. No.: 392,587

[22] Filed: Aug. 11, 1989

[51] Int. Cl.[5] ..... F16K 55/18; F16K 15/00; F16L 55/18; B01D 21/30

[52] U.S. Cl. ..... 137/15; 137/38; 137/527.8; 137/544; 210/136; 210/169

[58] Field of Search ..... 137/544, 38, 527, 527.8, 137/1, 15; 210/169, 136

[56] References Cited

U.S. PATENT DOCUMENTS

| | | | |
|---|---|---|---|
| 1,297,603 | 3/1919 | Smith | 210/136 |
| 1,582,399 | 4/1926 | Helander | 137/544 |
| 3,132,364 | 5/1964 | Oxley | 210/169 |
| 3,360,129 | 12/1967 | Powers | 210/169 |
| 3,538,514 | 11/1970 | Schimert et al. | 137/527.8 |
| 3,630,364 | 12/1971 | Johnston | 210/169 |

FOREIGN PATENT DOCUMENTS

| | | | |
|---|---|---|---|
| 721539 | 11/1965 | Canada | 210/169 |

*Primary Examiner*—A. Michael Chambers

[57] ABSTRACT

Disclosed is an apparatus and a related method for removing sand, trash and other materials from a spa, pool, aquarium or other fluid bodies and which includes a hollow, generally tubular member with an exhaust opening along the tubular member near the bottom end for venting fluid, and with a fabric bag fixed over the exhaust opening for passing the fluid but retaining the recovered material. One-way valve near the bottom end and in the exhaust opening ensure that fluid flow passes only upwardly through the tubular member and thereafter out of the exhaust opening.

13 Claims, 2 Drawing Sheets

17
(A)
16
12
11
15
(B)
22
(C)
32
28
40
46
D2
48
46
48
24
(D)
40
13
18
(F)
21

42
46
47
50
48
V'
44
V 42
40
46
47
24
44

40
46
42
47
44

49
50
49
48

36
17
(G)
34
14
12
22
10
26
32
18

36
34

APPARATUS AND METHOD FOR RECOVERING MATERIALS FROM FLUID BODIES

BACKGROUND OF THE INVENTION

1. Field of the Invention

The present invention relates to apparatus and methods for recovering materials from a fluid body, such as a spa, pool, aquarium or the like, stream, pond, lake or the like.

2. Description of the Prior Art

Outdoor spas, pools and aquariums suffer a disadvantage in that solid material may be tracked in or blown into the fluid body and sink to the bottom. There are a variety of commercially available skimmers and fabric bag arrangements mounted on the end of a pole for permitting the removal of such sunken materials. However, it is frequently difficult to remove all of these materials with such prior art arrangements without an external power system.

Siphon pumps are also well know in the prior art. See for example, the following U.S. Pat. Nos.: 1,582,399 to Helander; 4,073,305 to Brown et al.; and 4,263,934 to Redden et al.

SUMMARY OF THE INVENTION

The present invention contemplates an apparatus and a related method for removing materials from a spa, pool, aquarium or other similar fluid body without altering the fluid. The apparatus includes a hollow, generally tubular member having first and second ends and a dimension between those ends such that the first end extends above a fluid body from which materials are to be removed and such that the second end extends into the fluid body adjacent to or on the area where the material is located. The tubular member has a first aperture at the first end which may be opened or closed to alternatively release or trap air within the tubular member. Such closure means may constitute any kind of a conventional flap mechanism, but preferably comprises the operator's hand or thumb which is placed over the first aperture to interdict air flow from the tubular member as it is pushed downwardly into the fluid body so that the second end is adjacent to or on top of the material to be removed.

The tubular member further includes a second aperture at the second end, and an exhaust opening along the tubular member near the second end for venting the fluid and material within the tubular member. Means are provided over the exhaust opening for trapping the materials flowing from the exhaust opening.

In a preferred embodiment, the trapping means comprises a fabric bag fixed over the exhaust opening for passing the fluid while retaining the solid materials. It is also preferred that first and second one-way valves be provided with the first one-way valve positioned in the tubular member between the second aperture and the exhaust opening for permitting fluid flow and material through that first valve in a first direction toward the exhaust opening and to thereafter restrict flow in a direction opposite to the first direction when the first end of the tubular member is thereafter elevated. The second one-way valve is positioned in the exhaust opening for permitting the passage of fluid and material through the exhaust opening from the tubular member and to thereafter restrict flow back into the tubular member.

Further, in accordance with the preferred embodiment, the tubular member includes a section, depending on usage; having an enlarged cross-section along a portion adjacent the second end, with the exhaust opening positioned in the enlarged second end. It is also preferred that the second end is notched or serrated to prevent large objects or debris from being drawn into and wedged in the second end.

Each of the first and second one-way valves preferably is fabricated in a low-cost, facile manner from a ring-shaped molded plastic member having a central passageway and a curved valve closure guide molded integrally therewith and extending from one side. A flat valve closure disc is provided and which has an opening for receiving the valve closure guide.

In accordance with the method of the present invention, air is trapped in the tubular member by covering the first open end, and thereafter the second end is extended into the fluid body and adjacent to or on the material to be recovered. Thereafter, the first opening is uncovered to release the trapped air and to effectuate the flow of fluid and the material by suction into the second end and into the enlarged portion. The first end of the tubular member is then partially lifted out of the fluid body so that the fluid and the recovered materials flow out of the enlarged portion and only through the exhaust opening, by reason of the closure of the first one-way valve at the bottom of the enlarged portion. As the fluid and the recovered material pass through the exhaust opening, the fluid passes out of the fabric bag while the recovered materials (such as sand and other trash) are trapped within the fabric bag. These steps are repeated until all of the recovered materials are reclaimed.

THE DRAWINGS

FIG. 3(*a*) is a cross-sectional side view of an inexpensive one-way valve construction in accordance with the present invention.

FIG. 3(*b*) is a front elevation of the valve shown in FIG. 3(*a*).

FIG. 3(*c*) is a perspective illustration of the one-way valve shown in FIGS. 3(*a*) and 3(*b*), and with the valve closure member removed from the valve closure guide.

FIG. 3(*d*) is a cross-sectional view of the valve closure element 48 of FIG. 3(*c*), taken along the line V—V'.

DETAILED DESCRIPTION

A detailed description of the preferred embodiment of both the apparatus and the method of the present invention will now be described with reference to the drawings.

Figures 1, 2, 3A, 3B, 3C, 3D, 6:
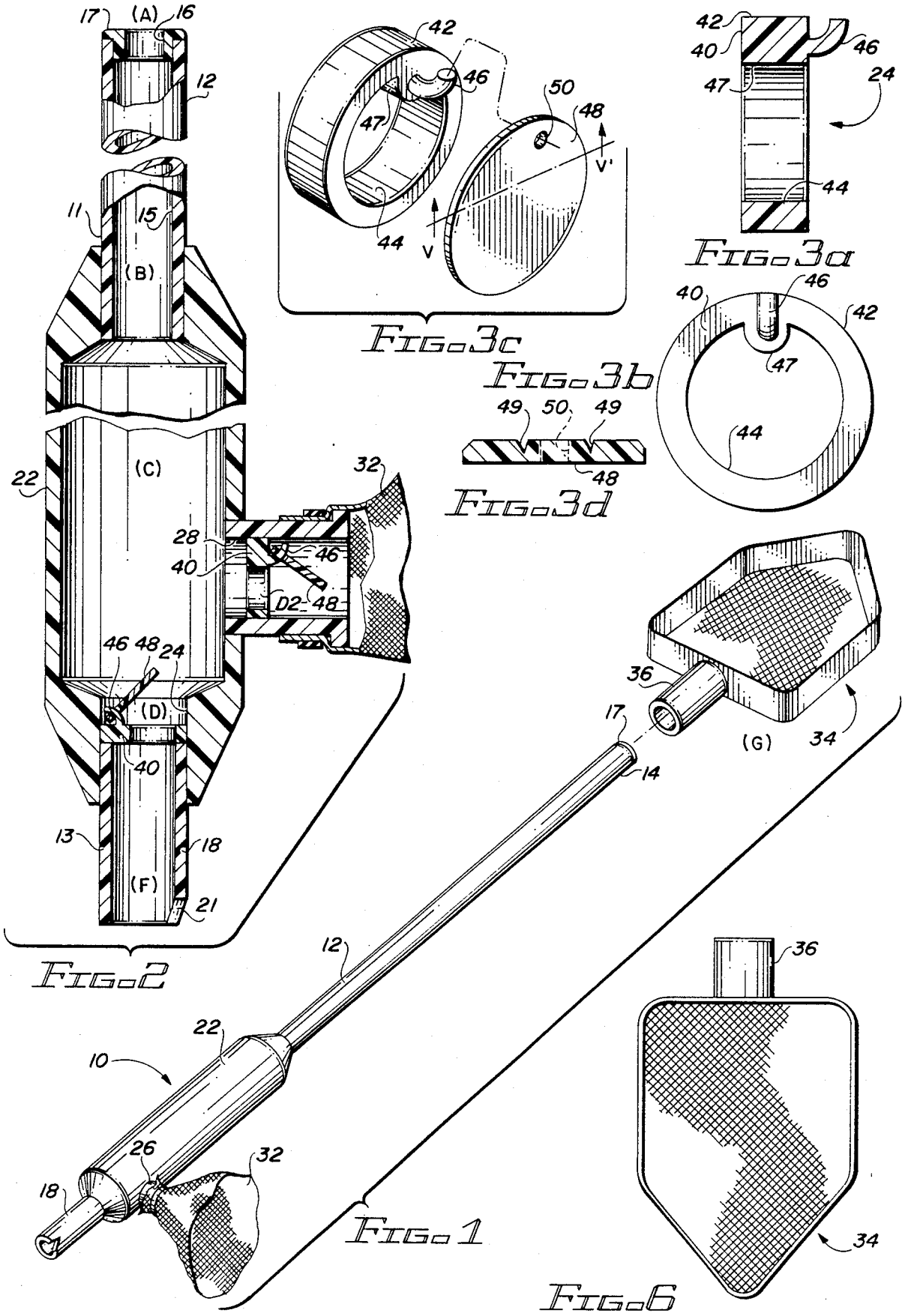
FIG. 1 is a perspective view illustrating the apparatus in accordance with the present invention.
FIG. 2 is a cross-sectional elevation of the apparatus shown in FIG. 1, with a substantial portion of the tubular member 12 broken away for illustration purposes.
FIG. 6 is a top plan view of a skimmer tray useful in the present invention.

First noting FIGS. 1 and 2, the apparatus 10 includes a tubular member 12 having a first end 14 and a second end 18. The apparatus 10 includes a first aperture 16 at the first end 14 and a second aperture 20 at the second end 18. As will be described further below, a thumb port 17 is located in the first aperture 16.

As is detailed in FIG. 2, the tubular member 12 consists of upper and lower sections 11 and 13, respectively, and an intermediate section 22 of enlarged cross-section with respect to the upper and lower sections. While the entire tubular member 12 including the sections 11, 13 and 22 may be integrally molded as a single piece, the construction shown in FIG. 2 contemplates three individual sections which are joined together in the manner shown.

In accordance with the preferred embodiment of this invention, the apparatus 10 is provided with a one-way valve 24 positioned at the upper extremity of the section 13 and at the entryway into the enlarged section 22 so as to permit the flow into the enlarged section 22 of fluid and materials, but to restrict the backflow of either the fluid or the recovered materials through the lower section 13 of the tubular member 12. The apparatus 10 further includes an exhaust pipe 26 forming an exhaust opening 28 along the lower portion of the enlarged section 22, and with a second one-way valve 40 positioned in the exhaust opening 28 so as to permit the flow of fluid and recovered materials out of the exhaust opening from the enlarged section 22. The construction of both one-way valves 24 and 30 is illustrated in FIGS. 3(*a*) and 3(*c*) and described in greater detail below.

Now noting FIG. 1, a fabric bag 32 is removably fixed to the exhaust pipe 26, and is formed of a fabric having interstices of a size sufficient to pass the fluid flowing through the second one-way valve 30 and the exhaust opening 28, but being sufficiently small so as to trap the recovered materials therein. As this trap bag 32 becomes filled, it may be removed in a conventional manner and emptied. As shown in FIGS. 1 and 2, the second end 18 is notched or serrated at 21 to prevent large objects or debris from being wedged in the apparatus 10.

The skimmer tray 34 includes a shaft 36 which is dimensioned to fit over the first end 14 and fastened in place. As shown in detail in FIG. 6, the skimmer tray 34 is specifically designed with beveled sides 33, 35 to reach into area of the spa, pool, etc, to remove large objects and debris (such as leaves and trash) before the apparatus 10 is used in the manner described above.

The construction details of the one-way valves 24 and 40 will now be described with reference to FIGS. 3(*a*)–3(*c*); while the first one-way valve 24 is shown in FIGS. 3(*a*)–3(*c*), it will be understood that the construction details of the one-way valve 30 are essentially identical.

In FIGS. 3(*a*)–3(*c*), reference numeral 42 refers to a molded, ring-shaped valve member 40 having a central, annular passageway 44 and an integrally molded valve closure guide 46 which curves outwardly and away from the central opening 44. A valve closure member 48 is provided with an opening 50 adapted to fit over the guide 46. This arrangement provides a simple, low-cost one-way valve construction which can be fabricated in a facile manner and which is not easily fouled by leaves and other material which is to be recovered by the apparatus 10. In a preferred form, the valve closure member 48 is fabricated from a material that will partially conform to the outside diameter of the valve body 40. A higher pressure valve may be obtained by partial segmenting of the closure member 48 via score lines 49 (see FIGS. 3(*d*)).

The method in which the apparatus 10 is employed to remove debris and other materials from the bottom of a spa, pool, aquarium or other similar fluid body will now be described with reference to FIGS. 4 and 5.

Figure 4:
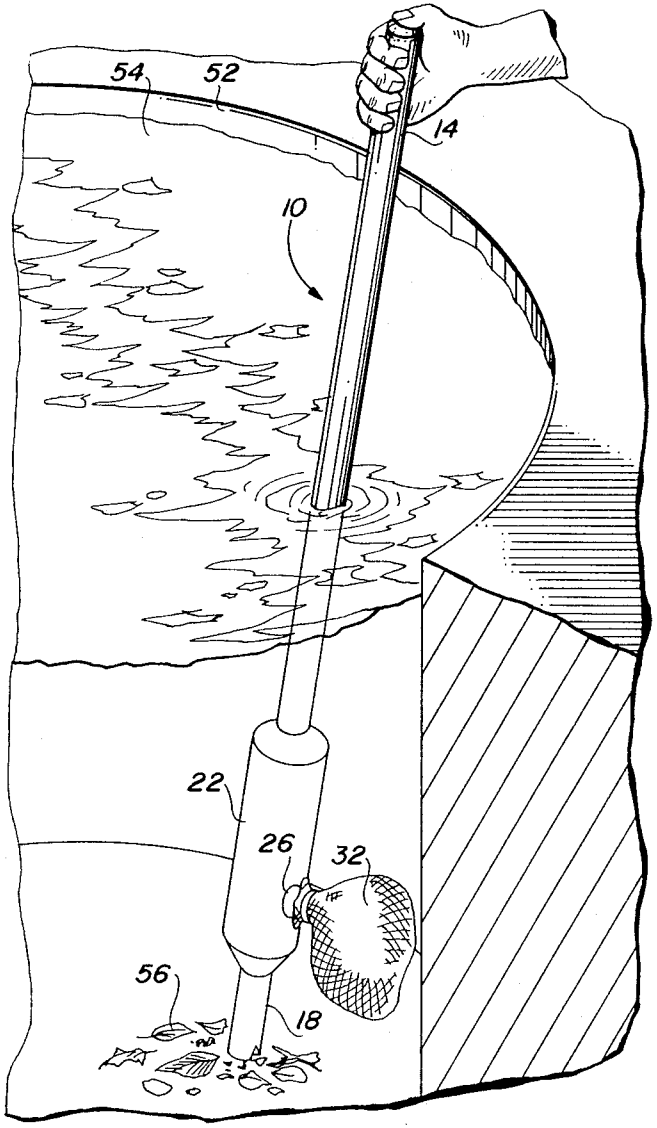
FIG. 4 is a perspective view illustrating a first step of the method in accordance with the present invention.

Referring first to FIG. 4, the aperture at the first, upper end 14 is covered, as with the operator's hand or thumb. This is accomplished before inserting the second end 18 of the apparatus 10 into the body of water. As a consequence, air is trapped within the tubular member 12. Thereafter, the apparatus 10 is inserted into the fluid body 54 with the second end 18 extending adjacent to the bottom of the fluid body and just over the material to be removed. The hand or thumb is then removed from over the first end 14, releasing the air trapped within the tubular member 12. The differential and water pressure causes water to rush into the second end 18 of the apparatus 10, drawing the material to be recovered into the apparatus along with the fluid flowing therein by virtue of that pressure differential. The fluid and recovered materials then flow into the section 22 of enlarged cross-section via the first one-way valve 24.

Figure 5:
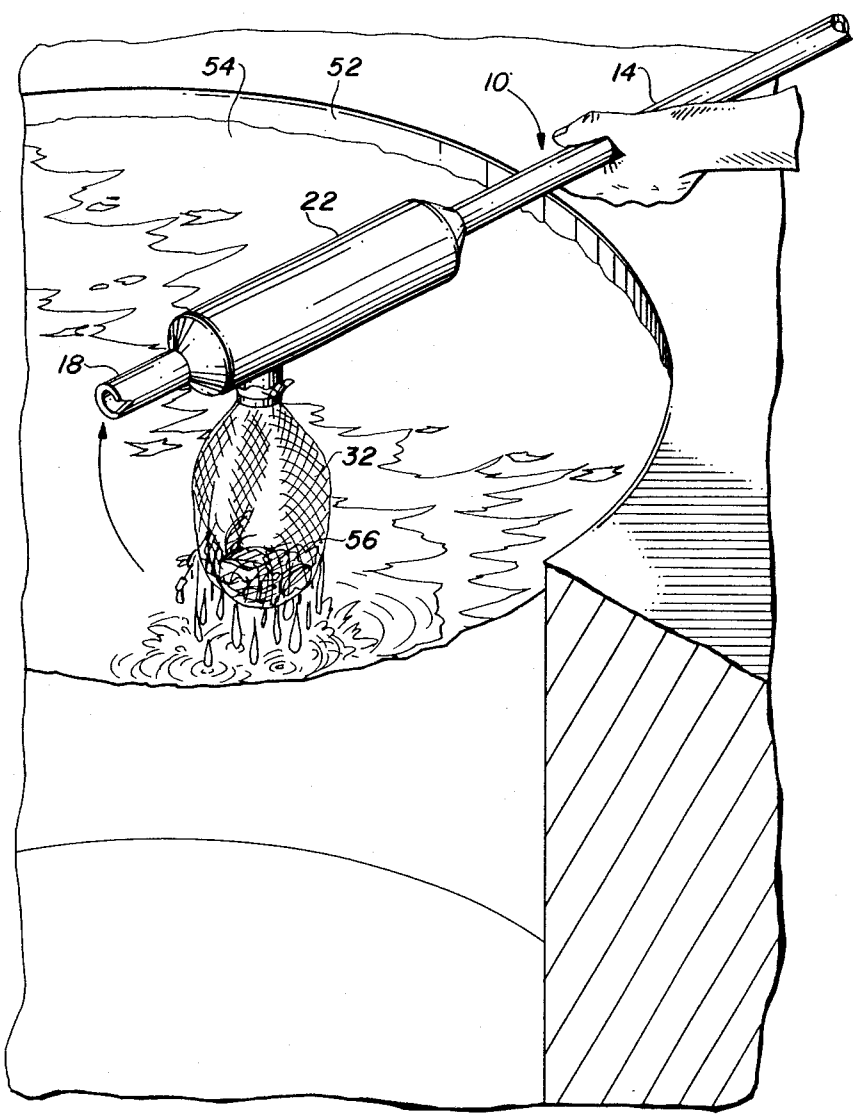
FIG. 5 is a perspective view illustrating a further step of the method in accordance with the present invention.

Reference is now made to FIG. 5. The second end 18 of the apparatus 10 is then elevated, preferably above the top of the fluid body 54, causing the fluid and recovered material to pass out of the exhaust opening 28 and through the second one-way valve 30. The fluid passes easily out of the trap bag 32, but the recovered materials are trapped therein. Thereafter, the various steps described above are repeated until all of the recovered material at the bottom of the fluid body 54 located within the fluid container 52 has been removed. The trap bag 32 is then emptied.

As discussed above, in order to remove any remaining large material in the fluid body 54, the skimmer tray 34 may be attached to the first end 14 of the apparatus 10, and used in a conventional manner to skim leaves and other materials from the surface of, or suspended in, the fluid body 54.

It will thus be understood that there has been described a simple, low-cost apparatus for achieving the recovery of materials from a fluid body without a requirement for electrical pumping mechanisms or similar complex apparatus or external power sources.

What is claimed is:

1. A method for removing leaves, trash and other materials from a spa, pool, aquarium or other similar fluid body, the method comprising the steps of:

(a) providing a generally tubular member having first and second open ends, a portion of enlarged cross-section adjacent said second end, an exhaust opening extending through said enlarged portion and valve means for permitting fluid flow from said second open end into said enlarged portion and only out of said exhaust opening;

(b) trapping air in said tubular member by covering said first open end;

(c) extending said second open end into a fluid body and adjacent recovered materials to be removed;

(d) uncovering said first end to release the trapped air and to effectuate the flow of fluid and material into said second end and into said enlarged portion;

(e) lifting said tubular member at least partially out of said fluid body so that said fluid and recovered materials flow out of said enlarged portion only through said exhaust opening;

(f) trapping said recovered materials at said exhaust opening and simultaneously passing said fluid; and (g) repeating steps (b) through (f) above until all of the materials are removed.

2. Apparatus for recovering sand, leaves, trash and other materials from a spa, pool, aquarium or other similar fluid body, said apparatus comprising:

a hollow generally tubular member having first and second ends and a dimension between said ends such that said first end extends above a fluid body from which materials are to be removed and such that said second end extends into said fluid body adjacent to the area where the material is located;

said tubular member having a first aperture at said first end which may be opened or closed to alternately release or trap air within said tubular member;

said tubular member having a second aperture at said second end;

an exhaust opening along said tubular member near said second end for venting fluid within said tubular member means over said exhaust opening for trapping said recovered materials flowing from said exhaust opening; and a one-way valve is said tubular member between said second aperture and said exhaust opening for permitting the passage through said valve in a first direction of fluid and material toward said exhaust opening from said second aperture and restricting flow in a direction opposite to said first direction.

3. The apparatus recited in claim 1 wherein said trapping means comprises means for passing said fluid while retaining and recoverable materials.

4. The apparatus recited in claim 2 further comprising a second one-way valve in said exhaust opening for permitting the passage of fluid and recovered material through said exhaust opening from said tubular member and restricting flow back into said tubular member.

5. The apparatus recited in claim 4 wherein said tubular member includes a second section of enlarged dimension along a portion thereof adjacent said second end.

6. The apparatus recited in claim 5 wherein said exhaust opening extends through said section of enlarged dimension.

7. The apparatus recited in claim 5 wherein said first one-way valve is located at the end of said section of enlarged dimension nearest said second aperture.

8. The apparatus recited in claim 6 wherein said trapping means comprises a flexible bag fitted over said exhaust opening and having interstices therein for passing fluid, the interstices being sufficiently small so as to trap the recoverable material.

9. The apparatus recited in claim 2 wherein said first end of said tubular member is dimensioned to receive a skimmer tray.

10. The apparatus recited in claims 2 or 4 wherein each of said first and second one-way valves comprise:

a ring-shaped molded plastic member having a central passageway and a curved valve closure guide extending from one side thereof; and a flat valve closure disc having an opening for receiving said guide.

11. The apparatus recited in claim 10 wherein said guide curves away from said central passageway.

12. Apparatus for removing leaves, trash and other materials from a spa, pool, aquarium or other similar fluid body, said apparatus comprising:

a hollow, generally tubular member having first and second ends and a dimension between said ends such that said first end extends above a fluid body from which materials are to be removed and such that said second end extends into said fluid body adjacent to the area where recoverable material is located;

said tubular member having a first aperture at said first end which may be opened or closed to alternately release or trap air within said tubular member;

an exhaust opening along said tubular member near said second end for venting fluid within said tubular member;

said tubular member including a section of enlarged dimension along a portion thereof adjacent said second end;

an exhaust opening along said enlarged section near said second end for venting fluid within said tubular member;

valve means for permitting fluid flow from said second aperture and into said enlarged section and then only out of said exhaust opening; and means over said exhaust opening for trapping said recovered materials flowing out of said exhaust opening.

13. Apparatus recited in claim 12 wherein said valve means comprising a first one-way valve communicating with said second aperture and a second one-way valve in said exhaust opening.

* * * * *